US006675426B2

(12) United States Patent
Ohm et al.

(10) Patent No.: US 6,675,426 B2
(45) Date of Patent: Jan. 13, 2004

(54) DAMP MOP

(75) Inventors: Heinz Josef Ohm, Limburg (DE); Klaus-Jürgen Fischer, Holzappel (DE)

(73) Assignee: Leifheit AG, Nassau (DE)

( * ) Notice: Subject to any disclaimer, the term of this patent is extended or adjusted under 35 U.S.C. 154(b) by 40 days.

(21) Appl. No.: 09/854,840

(22) Filed: May 14, 2001

(65) Prior Publication Data

US 2002/0056167 A1 May 16, 2002

(30) Foreign Application Priority Data

Nov. 15, 2000 (EP) ..... 00124864

(51) Int. Cl.[7] ..... A47L 13/146
(52) U.S. Cl. ..... 15/119.2; 15/244.2; 15/228
(58) Field of Search ..... 15/119.1, 119.2, 15/116.1, 116.2, 244.1, 244.2, 228

(56) References Cited

U.S. PATENT DOCUMENTS

| | | | | | |
|---|---|---|---|---|---|
| 2,730,744 | A | * | 1/1956 | Vaughn | 15/119.2 |
| 2,892,201 | A | * | 6/1959 | Peterson et al. | 15/119.2 |
| 3,224,025 | A | * | 12/1965 | Altrock | 15/119.2 |
| 4,831,677 | A | * | 5/1989 | Morrison et al. | 15/119.2 |
| 5,272,783 | A | * | 12/1993 | Richardson et al. | 15/119.2 |
| 5,488,750 | A | | 2/1996 | Vosbikian et al. | |
| 6,119,297 | A | * | 9/2000 | Ohm et al. | 15/119.2 |
| 2002/0120994 | A1 | * | 9/2002 | Hirse | 15/119.2 |

FOREIGN PATENT DOCUMENTS

| | | | | |
|---|---|---|---|---|
| BE | 496850 | * | 11/1950 | 15/119.2 |
| CA | 0466474 | * | 7/1950 | 15/119.2 |
| DE | 216565 | * | 11/1909 | 15/119.2 |
| DE | 39 23 859 A1 | | 2/1990 | |
| EP | 0 494 021 A1 | | 7/1990 | |
| NO | 76184 | * | 1/1950 | 15/119.2 |

OTHER PUBLICATIONS

Copy of advertisement for Quickie Home–Pro Automatic Scrubber Mop, referring to USP 5,488,870.

* cited by examiner

*Primary Examiner*—Gary K. Graham
(74) *Attorney, Agent, or Firm*—Frishauf, Holtz, Goodman & Chick, P.C.

(57) ABSTRACT

A damp mop for plane surfaces having two mop plates 1, 2 that are coupled to a handle 13 and that have a mop pad 35 provided thereon. The two mop plates 1,2 are joined by a double joint 3, and can be pressed against one another by pressure arms 19, 20 disposed on a slide sleeve. The handle 13 is secured pivotably to the double joint 3 via a cardan joint 8.

7 Claims, 4 Drawing Sheets

DAMP MOP

FIELD OF THE INVENTION

The invention relates to a damp mop having two mop plates that are coupled to a handle and joined by a double joint, and that can be pressed against one another by pressure arms disposed on a slide sleeve.

DESCRIPTION OF THE PRIOR ART

One such damp mop was disclosed by U.S. Pat. No. 2,730,744. A disadvantage of the embodiment disclosed in that patent is that the handle cannot be pivoted in the main mopping direction. This makes it extremely difficult and sometimes impossible to mop under cupboards and in interstices.

This disadvantage also pertains to the mopping device of European Patent Disclosure EP 0 494 021 B1.

OBJECT OF THE INVENTION

The object of the invention is to provide a damp mop for plane surfaces with which it is possible to clean under low furniture in the main mopping direction, and with which mopping can be done in narrow interstices. It is also an object of the invention to ensure that the mop can be manipulated in a secure and malfunction-free manner.

SUMMARY OF THE INVENTION

The objects of the invention are attained by providing damp mop for plane surfaces comprising a handle, two mop plates that are coupled to the handle, and that are joined by a double joint;a mop pad provided on the two mop plates; a slide sleeve supported on the handle; pressure arms that are disposed on the slide sleeve, and that are adapted to press the two mop plates together wherein the handle is secured pivotably to the double joint via a cardan joint, and wherein guide devices are provided on at least one of the mop plates and the pressure arms.

With the cardan joint, it is possible to mop in an especially flat position, so that work can be done even under low cupboards. Furthermore, the cardan joint makes mopping possible in any direction, and in particular in a direction counter to the main wiping direction. This makes professional-style mopping possible, in a so-called figure-8 pattern. The articulation of the pressure arms on the mop plates via guide devices also makes it possible to squeeze out the mop in any arbitrary position. And there is no need to balance the handle in a defined direction to the mop plates.

In an especially simple way, the guidance of the pressure arms may be effected by V-shaped guide ribs to allow the pressure arms to slide on pressure faces on the mop plates. Naturally, these guide ribs can also be replaced with guide grooves.

An especially elegant way of structuring the mop of the present invention may by achieved by forming slaving parts on each of the mop plates toward the joint for being guided in grooves in the pressure arms. The grooves may be provided with an undercut, by way of which the slaving parts can be interlocked by nonpositive engagement. This makes it possible, without any additional spring or other aids, to straighten out the mop plates after the mop has been squeezed out.

To optimize the squeezing force, run-up faces that slope upward on the mop plates may be provided for the pressure arms, which reach their high point at the pressure face.

To stabilize the mop plates in the mopping process, the slaving parts and basic joint parts formed onto the double joint are in nonpositive contact.

BRIEF DESCRIPTION OF THE DRAWINGS

One exemplary embodiment of the invention will be described in further detail below in conjunction with the drawings, in which.

DETAILED DESCRIPTION

Figure 1:
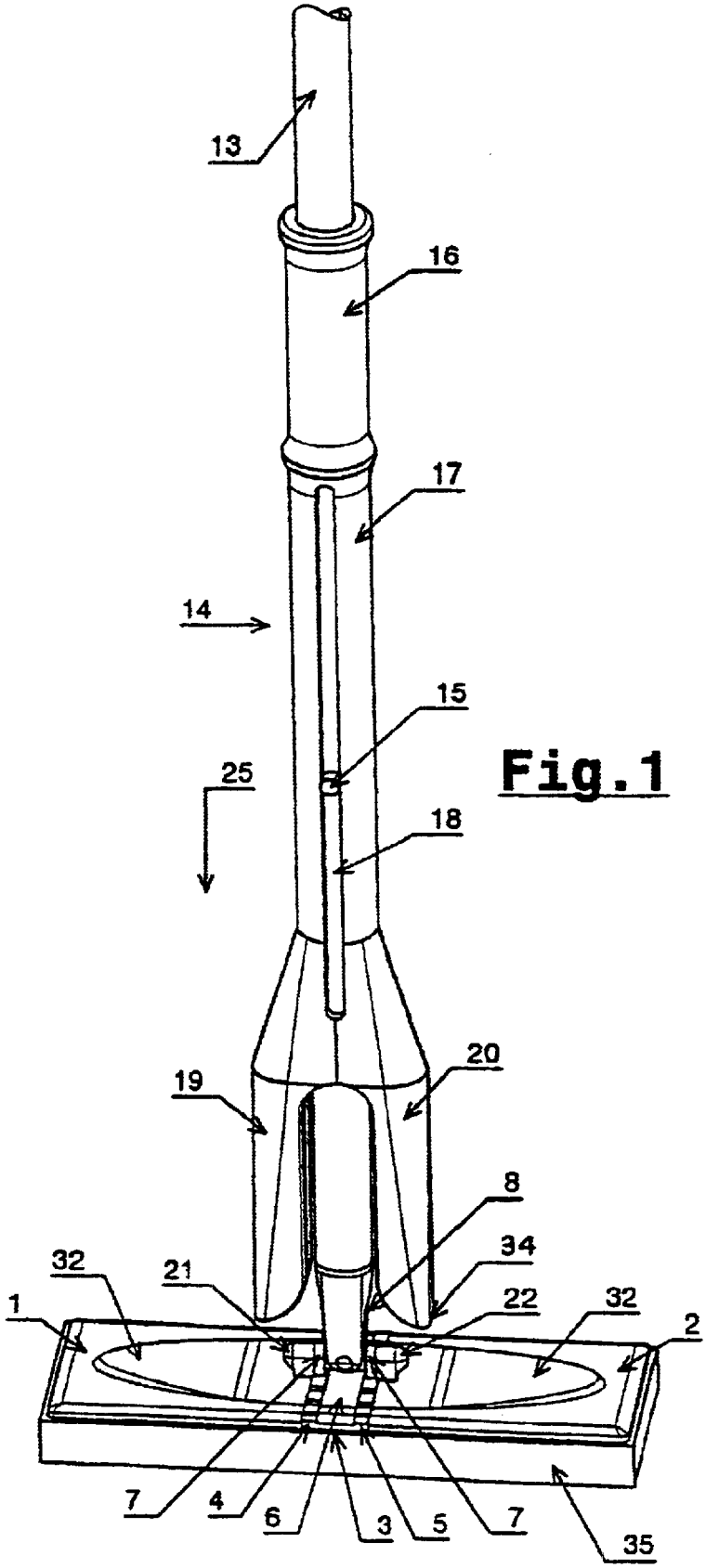
FIG. 1 is a perspective view of a damp mop.

Two mop plates 1 and 2 are joined together with the interposition of a double joint 3. The double joint 3 is formed by two hinges 4, 5, which form the connection from an intermediate plate 6 to the two mop plates 1 and 2. Two basic joint parts 7 are formed onto the intermediate plate 6 and receive a cardan joint 8. The cardan joint 8 comprises a lengthwise shaft 9, supported in the basic joint parts 7, with shaft head 10 that in turn is pierced by a transverse shaft 11 on which a handle receptacle 12 is rotatably supported. A handle 13 is connected to the handle receptacle 12.

A slide sleeve 14 is displaceably supported on the handle 13 up to a stop 15 that is secured to the handle 13. The slide sleeve 14 comprises a gripping part 16, a sliding region 17 with a guide slot 18, and pressure arms 19 and 20 that are formed in forked fashion.

Figure 2:
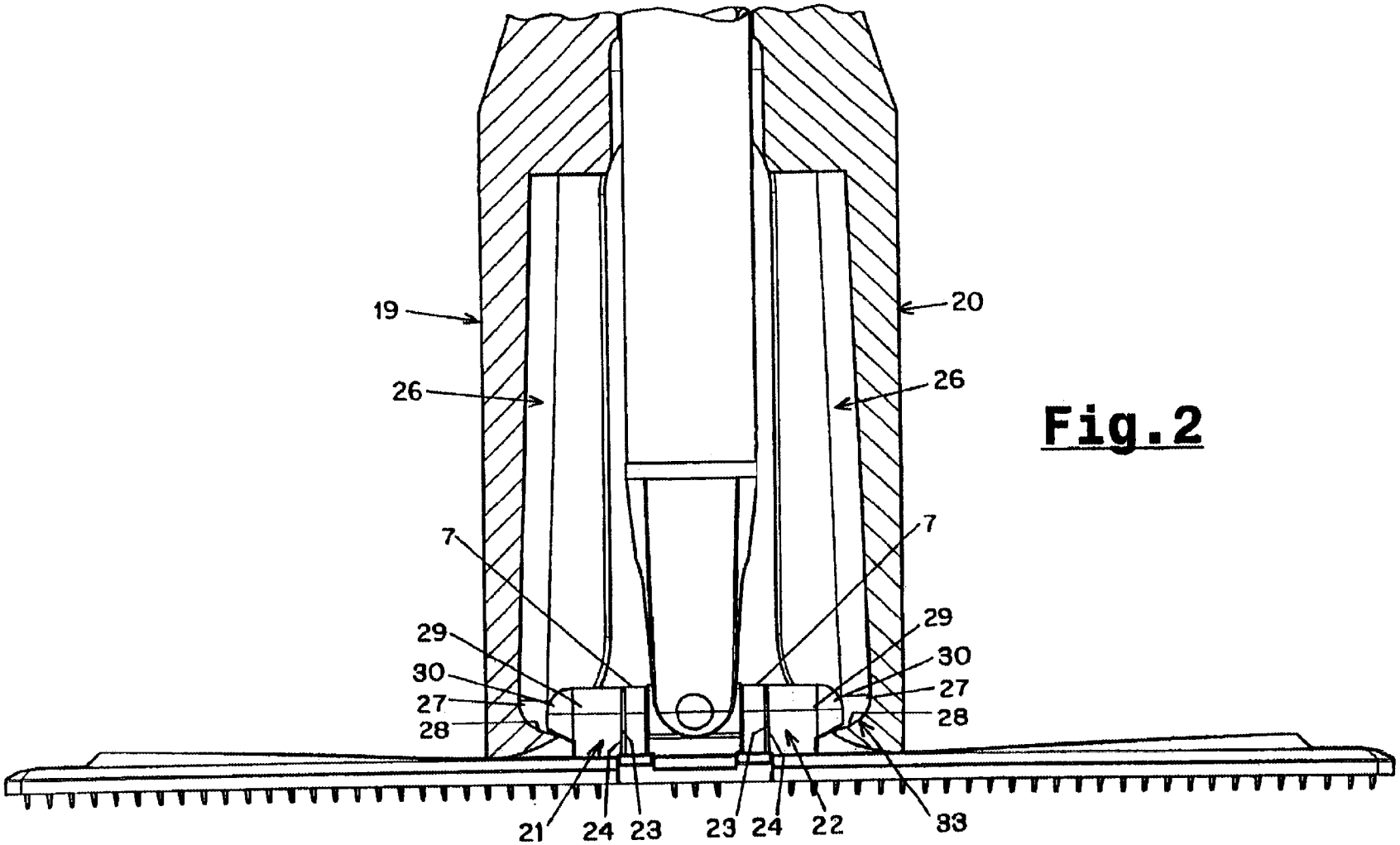
FIG. 2 is a longitudinal section of the onset of engagement of the pressure arms with the mop plates.

For squeezing out the mop, the pressure arms 19, 20 can be brought into operative connection with the mop plates 1 and 2 via the slide sleeve 14. To that end, one slaving part 21, 22 is formed onto each of the mop plates 1 and 2 toward the joint. The slaving parts 21, 22 stand perpendicularly on the mop plates 1, 2 and rest with a face 23, as seen in FIG. 2, on a back face 24 of the basic joint parts 7. When the slide sleeve 14 is displaced in the direction of the arrow 25 out of its position shown in FIG. 1, the pressure arms 19, 20 come into engagement with the slaving parts 21 and 22. To that end, each of the pressure arms 19 and 20 has a groove 26, and these grooves are each terminated at the ends 27 by a respective wall 28. Because of the resilience of the construction, upon impact of the pressure arms 19, 20 with the slaving parts 21, 22, the walls 28 yield in such a way that, as shown in FIG. 2, they lock behind L-shaped extensions 29, which take the form of a ball 30. The L-shaped extensions 29 have the cross-sectional shape of the groove 26, so that good sliding performance and secure guidance are assured.

Figure 3:
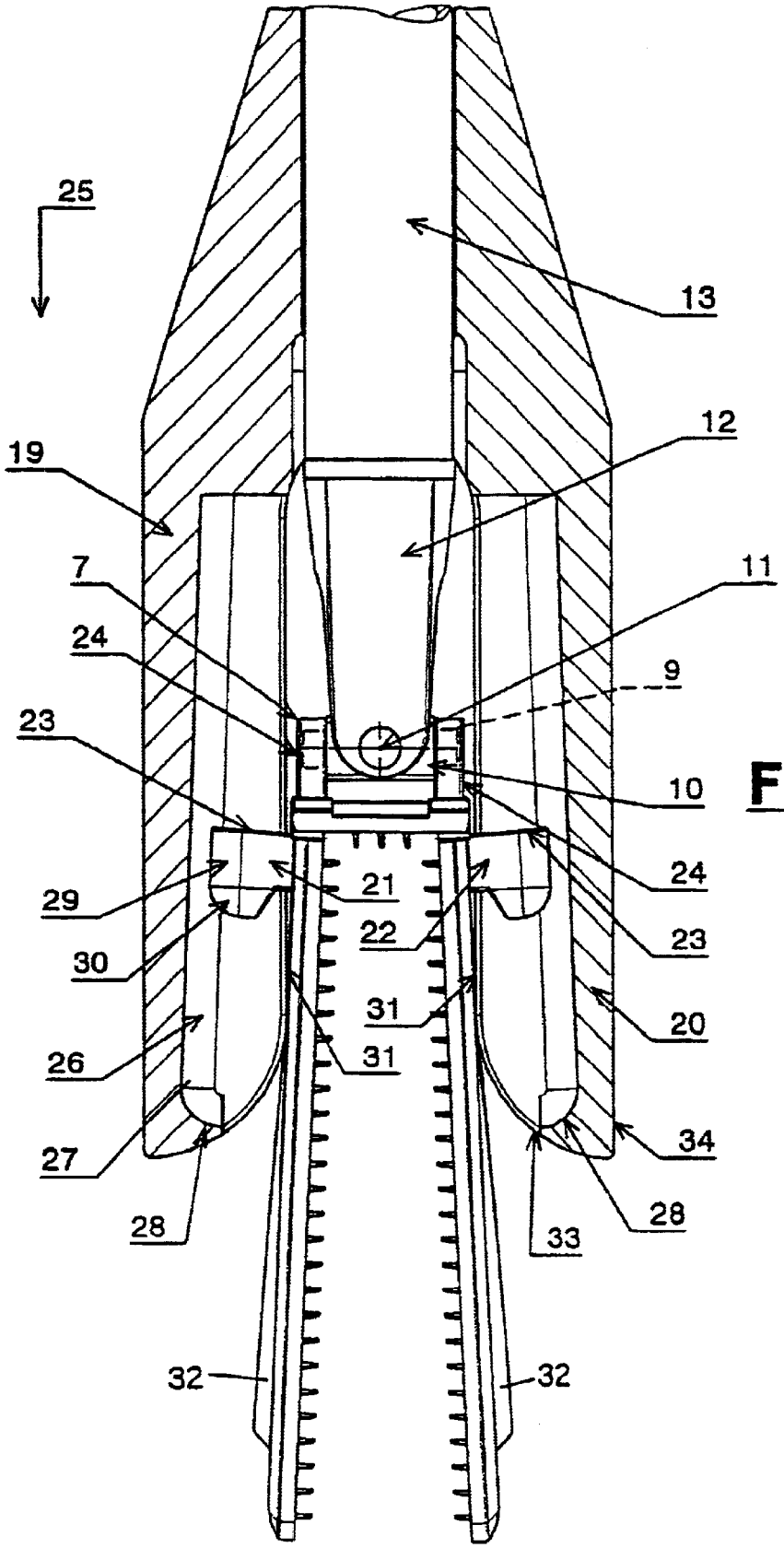
FIG. 3 is a longitudinal section in the retracted position of the mop plates.
Figure 4:
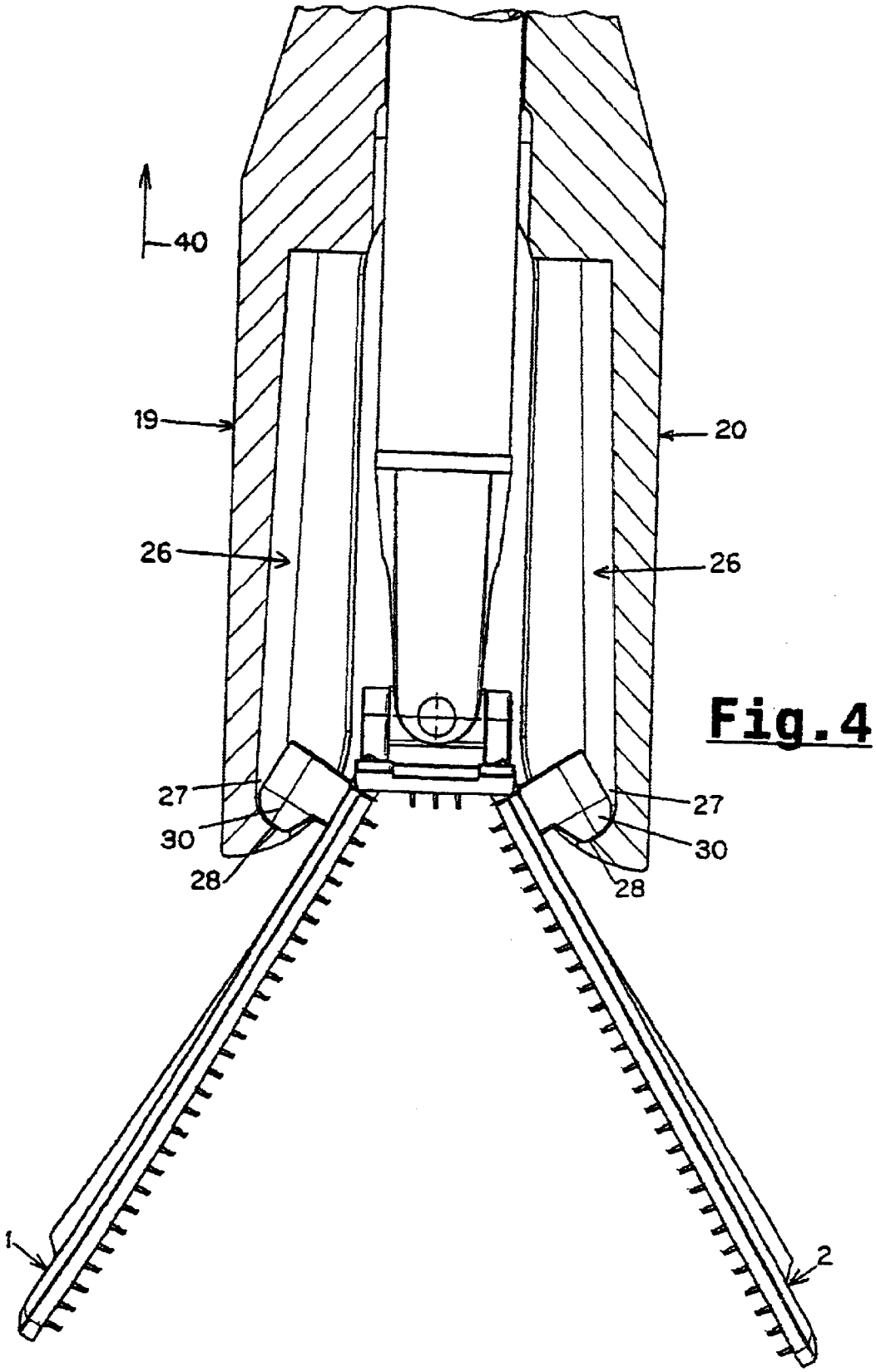
FIG. 4 is a longitudinal section at the instant of slaving of the mop plates in the direction of the extended position.

Further displacement of the slide sleeve 14 in the direction of the arrow 25 causes the mop plates 1 and 2 to fold inward and together as shown in FIG. 3, thus squeezing out the mop pad 35. In the process, pressure arms 19, 20 are guided by V-shaped guide ribs 31 to slide on upward-sloping pressure faces 32 on the mop plates 1 and 2.

After the mop pad, not shown in all the drawings, has been squeezed out via the mop plates 1 and 2, the slide sleeve 14 is retracted in direction 40 counter to the direction 25, until the walls 28 strike the ball 30 and thus begin to extend the mop plates 1, 2 and first put them in the position shown in FIG. 3 and then in the position shown in FIG. 2. Further retraction of the slide sleeve 14 causes the walls 28, because of the natural spring properties of the materials, to yield backward under pressure so far that the position shown in FIG. 1 is regained. In this position, by means of the cardan joint, mopping in any direction is possible. For example, even if the handle 13 is positioned very obliquely, the pressure arms 19 and 20 reliably meet the slaving parts 21 and 22. This effect is contributed to by the inlet radii 33 at the end 34 of the pressure arms 19, 20.

What is claimed is:

1. A damp mop for plane surfaces comprising:

a handle;

two mop plates that are coupled to the handle, and that are joined by a double joint;

a mop pad provided on the two mop plates;

a slide sleeve supported on the handle;

pressure arms that are disposed on the slide sleeve, and that are adapted to press the two mop plates together;

wherein the handle is secured pivotably to the double joint via a cardan joint, and wherein guide ribs are provided on and extending along each of the pressure arms for facilitating sliding between the mop plates and the pressure arms.

2. A damp mop, for plane surfaces comprising:

a handle;

two mop plates that are coupled to the handle, and that are joined by a double joint;

a mop sad provided on the two mop plates;

a slide sleeve supported on the handle;

pressure arms that are disposed on the slide sleeve, and that are adapted to press the two mop plates together;

wherein the handle is secured pivotably to the double joint via a cardan joint, wherein guide ribs are provided on the pressure arms for facilitating sliding between the mop plates and the pressure arms, and wherein the guide ribs extend in a V shape and are slidable on a pressure face provided on each of the mop plates.

3. The damp mop of claim 2, wherein each of the pressure faces slopes upward and outward from a center of each of the mop plates.

4. A damp mop for plane surfaces comprising:

a handle;

two mop plates that are coupled to the handle, and that are joined by a double joint;

a mop pad provided on the two mop plates;

a slide sleeve supported on the handle;

pressure arms that are disposed on the slide sleeve, and that are adapted to press the two mop plates together;

wherein the handle is secured pivotably to the double joint via a cardan joint, wherein guide devices are provided on at least one of the mop plates and the pressure arms, and wherein a slaving part is formed on a joint side of each of the mop plates, and a groove that guides a respective one of the slaving parts is provided in each of the pressure arms.

5. The damp mop of claim 4, wherein each of the grooves is provided with an undercut for achieving nonpositive-engagement interlocking to a respective one of the slaving parts.

6. The damp mop of claim 4, wherein the slaving parts are formed at right angles to the mop plate, and wherein a first side of each slaving part contacts a respective basic joint part of the double joint and a second side of each slaving part terminates as a ball in an L-shaped extension.

7. The damp mop of claim 6, wherein the double joint comprises two basic joint parts that are each formed peripherally at right angles on respective sides of an intermediate plate, and wherein the two basic joint parts together with the intermediate plate, in an extended state of the mop plates, form a nonpositive-engagement unit.

* * * * *